US005763813A

United States Patent [19]

Cohen et al.

[11] Patent Number: 5,763,813

[45] Date of Patent: Jun. 9, 1998

[54] COMPOSITE ARMOR PANEL

[75] Inventors: Michael Cohen; Avinoam Israeli, both of Mobile Post North Yehuda, Israel

[73] Assignee: Kibbutz Kfar Etzion, Israel

[21] Appl. No.: 704,432

[22] Filed: Aug. 26, 1996

[51] Int. Cl.[6] ..... F41H 5/04

[52] U.S. Cl. ..... 89/36.02; 109/84

[58] Field of Search ..... 89/36.02, 36.01; 109/82, 83, 84; 428/911

[56] References Cited

U.S. PATENT DOCUMENTS

| | | | |
|---|---|---|---|
| 3,523,057 | 8/1970 | Buck | 89/36.02 |
| 3,705,558 | 12/1972 | McDougal et al. | 109/84 |
| 4,061,815 | 12/1977 | Poole, Jr. | 428/215 |
| 5,134,725 | 8/1992 | Yeshurun et al. | 428/911 |
| 5,361,678 | 11/1994 | Roopchand et al. | 89/36.02 |

FOREIGN PATENT DOCUMENTS

| | | | |
|---|---|---|---|
| A1566448 | 5/1969 | France . | |
| A259254 | 8/1985 | France . | |
| A2711782 | 5/1995 | France . | |
| 2815582 | 3/1980 | Germany | 89/36.02 |
| A3228264 | 12/1985 | Germany . | |
| A3507216 | 9/1986 | Germany . | |
| A1081464 | 8/1967 | United Kingdom . | |
| A1352418 | 5/1974 | United Kingdom . | |
| A2272272 | 5/1994 | United Kingdom . | |

OTHER PUBLICATIONS

International Search Report (2pgs) conducted by the European Patent Office; File No. RS 96807; dated 27 Jun. 1996.

*Primary Examiner*—Stephen M. Johnson

[57] ABSTRACT

The invention provides a composite armor material for absorbing and dissipating kinetic energy from high velocity, armor-piercing projectiles, comprising a panel consisting essentially of a single internal layer of high density ceramic pellets having an $Al_2O_3$ content of at least 85% and a specific gravity of at least 2.5, said pellets being directly bound and retained in panel form by a solidified material which is elastic at a temperature below 250° C., the majority of said pellets each having a major axis in the range of about 3–12 mm, and being bound by said solidified material in a plurality of superimposed rows, wherein a majority of each of said pellets is in contact with at least 4 adjacent pellets, and the total weight of said panel does not exceed 45 kg/m$^2$.

13 Claims, 3 Drawing Sheets

COMPOSITE ARMOR PANEL

The present invention relates to a composite armor panel. More particularly, the invention provides an armored panel providing lightweight ballistic protection which may be worn by the user, and for protecting light mobile equipment and vehicles against high-speed fire-arm projectiles or fragments. The invention also includes methods for manufacturing the panel.

There are three main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. Due to its weight, such armor is quite unsuitable for light vehicles such as automobiles, jeeps, light boats, or aircraft, whose performance is compromised by steel panels having a thickness of more than a few millimeters.

Armor for light vehicles is expected to prevent penetration of bullets of any weight, even when impacting at a speed in the range of 700 to 1000 meters per second. The maximum armor weight which is acceptable for use on light vehicles varies with the type of vehicle, but generally falls in the range of 40 to 70 kg/m$^2$.

A second consideration is cost. Overly complex armor arrangements, particularly those depending entirely on synthetic fibers, can be responsible for a notable proportion of the total vehicle cost, and can make its manufacture non-profitable A third consideration in armor design is compactness. A thick armor panel, including air spaces between its various layers, increases the target profile and the wind resistance of the vehicle. In the case of civilian retrofitted armored automobiles which are outfitted with internal armor, there is simply no room for a thick panel in most of the areas requiring protection.

Fairly recent examples of armor systems are described in U.S. Pat. No. 4,836,084, disclosing an armor plate composite including a supporting plate consisting of an open honeycomb structure of aluminum; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed, e.g., in British Patents 1,081,464; 1,352,418; 2,272,272, and in U.S. Pat. No. 4,061,815 wherein the use of sintered refractory material, as well as the use of ceramic materials, are described.

Ceramic materials are nonmetallic, inorganic solids having a crystalline or glassy structure, and have many useful physical properties, including resistance to heat, abrasion and compression, high rigidity, low weight in comparison with steel, and outstanding chemical stability. Such properties have long drawn the attention of armor designers, and solid ceramic plates, in thicknesses ranging from 3 mm. for personal protection to 50 mm. for heavy military vehicles, are commercially available for such use.

Much research has been devoted to improving the low tensile and low flexible strength and poor fracture toughness of ceramic materials; however, these remain the major drawbacks to the use of ceramic plates and other large components which can crack and/or shatter in response to the shock of all incoming projectile.

A known form of armor plating using ceramics is produced in Israel by Kibbutz Beit Alpha. It comprises cutting 5 mm steel plates to the sizes required, heat-treating the steel and adding a ceramic coating. One disadvantage of this type of panel is that on completion the panels are almost impossible to modify. In use, the ceramic coating performs well against the first bullet, but tends to shatter, and thus fails to protect against further projectiles.

Light-weight, flexible armored articles of clothing leave also been used for many decades, for personal protection against fire-arm projectiles and projectile splinters. Examples of this type of armor are found in U.S. Pat. No. 4,090,005. Such clothing is certainly valuable against low-energy projectiles, such as those fired from a distance of several hundred meters, but fails to protect the wearer against high-velocity projectiles originating at closer range. If made to provide such protection, the weight and/or cost of such clothing discourages its use. A further known problem with such clothing is that even when it succeeds in stopping a projectile the user may suffer injury due to indentation of the vest to the body, caused by too small a body area being impacted and required to absorb the energy of a bullet.

A common problem with prior art ceramic armor concerns damage inflicted on the armor structure by a first projectile, whether stopped or penetrating. Such damage weakens the armor panel, and so allows penetration of a following projectile, impacting within a few centimeters of the first.

The present invention is therefore intended to obviate the disadvantages of prior art ceramic armor, and to provide an armor- panel which is effective against small-caliber fire-arm projectiles, yet is of light weight, i.e, having a weight of less than 45 kg/m$^2$ which is equivalent to about 9 lbs/ft$^2$, and low bulk.

A further object of the invention is to provide an armor panel which is particularly effective in arresting a plurality of projectiles impacting upon the same general area of the panel.

The above objectives are achieved by providing a composite armor material for absorbing and dissipating kinetic energy from high velocity, armor-piercing projectiles, comprising a panel consisting essentially of a single internal layer of high density ceramic pellets having an $Al_2O_3$ content or at least 85% and a specific gravity of at least 2.5, said pellets being directly bound and retained in panel form by a solidified material which is elastic at a temperature below 250° C., the majority of said pellets each having a major axis in the range of about 3–12 mm, and being bound by said solidified material in a plurality of superposed rows, wherein a majority of each of said pellets is in contact with at least 4 adjacent pellets, and the total weight of said panel (does not exceed 45 kg/m$^2$.

Said solidified material can be any suitable material, such as molten metal which is elastic at a temperature below 250° C., such as aluminum, epoxy, a thermoplastic polymer, or a thermoset plastic.

In a preferred embodiment of the present invention, there is provided an armored panel wherein the solidified material contains at least 80% aluminum.

In French Patent 2,711,782, there is described a steel panel reinforced with ceramic materials; however, due to the rigidity and lack of elasticity of the steel of said panel, said panel does not have the ability to deflect armor-piercing projectiles unless a thickness of about 8–9 mm of steel is used, which renders said panel too heavy for the purposes of the present invention.

It is further to be noted that the elasticity of the material used in the present invention serves, to a certain extent, to increase the probability that a projectile will simultaneously impact several pellets, thereby increasing the efficiency of the stopping power of the panel of the present invention.

In a further preferred embodiment of the invention, there is provided a multi-layered armor panel, comprising an outer, impact-receiving panel of composite armor material as hereinbefore defined, for deforming and shattering an impacting high velocity, armor-piercing projectile; and an inner layer adjacent to said other panel comprising second layer comprising a panel of tough woven textile material for causing an asymmetric deformation of the remaining fragments of said projectile and for absorbing the remaining kenetic energy from said fragments, said inner layer having a thickness of at least 50% of that of said outer, impact-receiving panel, wherein said panel is adapted to stop three bullets fired seqentially at a triangular area of said panel, the sides of said triangle being 5 cm each.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious (disadvantages, making it difficult to manufacture and less than entirely suitable for the purpose of defeating metal projectiles.

For example, McDougal, et al. U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive.

Composite armor plate as described in the McDougal, et al. patent is difficult to manufacture because the ceramic spheres may be damaged by thermal shock arising from molten metal contact. The ceramic spheres are also sometimes displaced during casting of molten metal into interstices between the spheres.

In order to minimize such displacement, Huet U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armor panel and decreases the stopping power thereof.

It is further to be noted that McDougal suggests and teaches an array of ceramic balls disposed in contacting pyrimidal relationship, which arrangement also substantially increases the overall weight of the armored panel and decreases the stopping power thereof, due to a billiard-like effect upon impact.

In U.S. Pat. No. 3,523,057 and 5,134,725 there are described further armored panels incorporating ceramic balls; however, said panels are flexible and it has been found that the flexibility of said panels substantially reduces their stopping strength upon impact, since the force of impact itself causes a flexing of said panels and a reduction of the supporting effect of adjacent ceramic balls on the impacted ceramic ball.

As will be realized, none of said prior art patents teaches or suggests the surprising and unexpected stopping power of a single layer of ceramic pellets which, as will be shown hereinafter, successfully prevents penetration of armor-piercing 7.6 mm calibre projectiles despite the light weight of the panel incorporating said pellets.

Thus, it has been found that the novel armor of the present invention traps incoming projectiles between several sphere-like, very hard ceramic pellets which are held in a single layer in rigid mutual relationship. The moderate size of the pellets ensures that the damage caused by a first projectile is localized and does not spread to adjoining areas.

An incoming projectile may contact the pellet array in one of three ways:

1. Centre contact. The impact allows the full volume of the pellet to participate in stopping the projectile, which cannot penetrate without pulverising the whole pellet, an energy-intensive task. The pellets used are either spheres or shapes approaching a spherical form, and this form, when supported in a rigid matrix, has been found to be significantly better at resisting shattering than rectangular shapes.

2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.

3. Valley contact. The projectile is jammed, usually between the flanks of three pellets, all of which participate in projectile arrest. The high side forces applied to the pellets are resisted by the pellets adjacent thereto as held by the solid matrix, and penetration is prevented. A test was arranged using a laser-aimed AK47 rifle firing an armor-piercing incindiary AK47 7.62 mm caliber round manufactured in Russia, to achieve this particular contact mode, and theory confirmation was obtained that such a result is indeed obtained ill practice.

During research and development for the present invention, the preparation of a plate-like composite casting was required, wherein ceramic pellets occupied a centre layer and cast aluminium completely embedded the pellets. When using molten metal the pellets would cool the molten metal, and furthermore, the required close pellet formation would be disturbed by the casting process. As mentioned above, this problem was encountered by McDougal in U.S. Pat. No. 3,705,558. An attempt to solve this problem was suggested by Huet in U.S. Pat. Nos. 4,534,266 and 4,945,814 and Roopchand, et al. in U.S. Pat. No. 5,361,678 suggested a further solution involving coating the ceramic bodies with a binder and ceramic particles, followed by tile introduction of the molten metal into the die.

It is therefore a further object of the present invention to provide a method of manufacturing composite armor material as described herein, without introducing non-essential and extraneous further components into the final panel.

Thus, the present invention provides a method for producing a composite armor material as defined hereinabove, comprising providing a mould having as bottom, two major surfaces, two minor surfaces and an open top, wherein the distance between said two major surfaces is from about 1.2 to about 1.8 times the major axis of said pellets; inserting said pellets into said mould to form a plurality of superposed rows of pellets extending substantially along the entire distance between said minor side surfaces, and from said bottom substantially to said open top; incrementally heating said mould and the pellets contained therein to a temperature of at least 100° C. above the flow point of the material to be poured in the mould; pouring molten material into said mould to fill the same; allowing said molten material to solidify; and removing said composite armor material from said mould.

The present invention also provides a method for producing a composite armor material, comprising providing a mould having a bottom, two major surfaces, two minor surfaces and an open top, wherein the distance between said two major surfaces is from about 1.2 to 1.8 times the major axis of said pellets; inserting said pellets into said mould to form a plurality of superposed rows of pellets extending substantially along the entire distance between said minor side surfaces, and from said bottom substantially to said open top, pouring liquid epoxy resin into said mould to fill the same; allowing said epoxy to solidify; and removing said composite armor material from said mould.

As will be realized, when preparing the composite armor, material of the present invention, said pellets do not necessarily have to be completely covered on both sides by said solidified material, and they can touch or even bulge front the outer surfaces of the formed panel.

Further embodiments of the invention, including weight-critical armored clothing, will also be described further below.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may, be embodied in practice.

Figure 1:
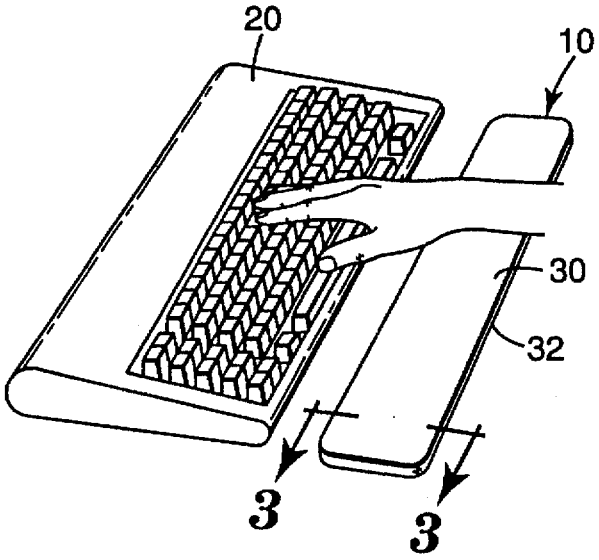
FIG. 1 is a perspective, fragmented view of a preferred embodiment of an armor panel according to the invention.

There is seen in FIG. 1 a composite armor material 10 for absorbing and dissipating kinetic energy from high velocity projectiles 12. A panel 14 is formed from a solidified material 16, the panel having an internal layer of high-density ceramic pellets 18. The outer faces of the panel are formed from the solidified material 16, and pellets 18 are embedded therein. The nature of the solidified material 16 is selected in accordance with the weight, performance and cost considerations applicable to the intended use of the armor.

Armor for land and sea vehicles is suitably made using a metal casting alloy containing at least 80% aluminum. A suitable alloy is Aluminium Association No. 535.0, which combines a high tensile strength of 35,000 kg/in$^2$, with excellent ductility, having 9% elongation. Further suitable alloys are of the type containing 5% silicon B443.0. These alloys are easy to cast in thin sections; their poor machinability is of little concern in the application of the present invention. An epoxy or other plastic or polymeric material, advantageously fiber-reinforced, is also suitable.

Pellets 18 have an alumina ($Al_2O_3$) content of at least 93%, and have a hardness of 9 on the Mohs scale. Regarding size, the majority of pellets have a major axis in the range of from about 3–12 mm, the preferred range being from 6–10 mm.

There are shown in FIG. 1, for illustrative purposes, a mixture of round pellets 18*a*, flat-cylindrical pellets 18*b*, and spherical pellets 18*c*. Considerations of symmetry, as well as tests carried out by the present inventor, indicate that the most effective pellet shape is spherical 18*c*. Ceramic pellets are used as grinding media in size-reduction mills of various types, typically in tumbling mills, and are thus commercially available at a reasonable cost.

In the finished panel 14, pellets 18 are bound by the solidified molten material 16 in a plurality of superimposed rows 20. A majority of pellets 18 are each in contact with at least 4 adjacent pellets.

In operation, the panel 14 acts to stop an incoming projectile 12 in one of three modes: centre contact, flank contact, and valley contact, as described above.

Figure 2:
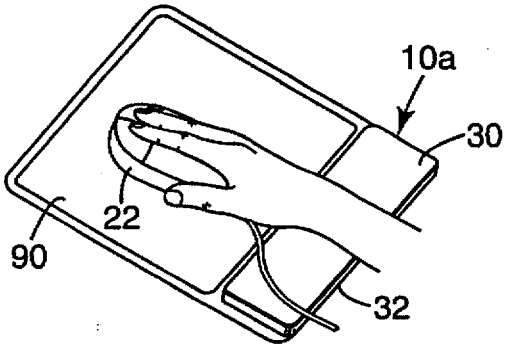
FIGS. 2 and 3 are perspective views of further pellet embodiments.

Referring now to FIG. 2, a further example of a pellet 18*d*, is depicted, said pellet having a regular, geometric, prismatic form, with one convex curved surface segment 22.

Figure 3:
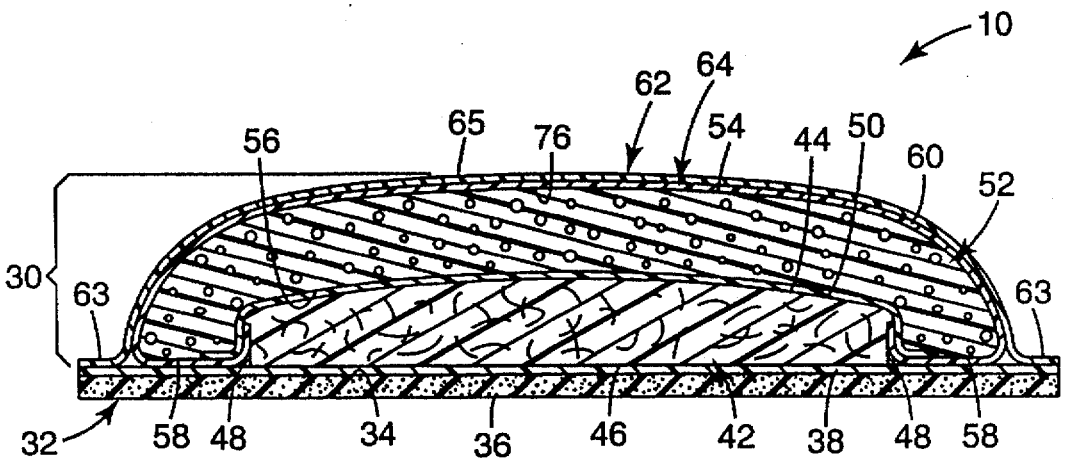

FIG. 3 shows a pellet 18*c* having a circular cross-section 24, taken at line AA. The pellet is of satellite form, and is commercially available.

Figure 4:
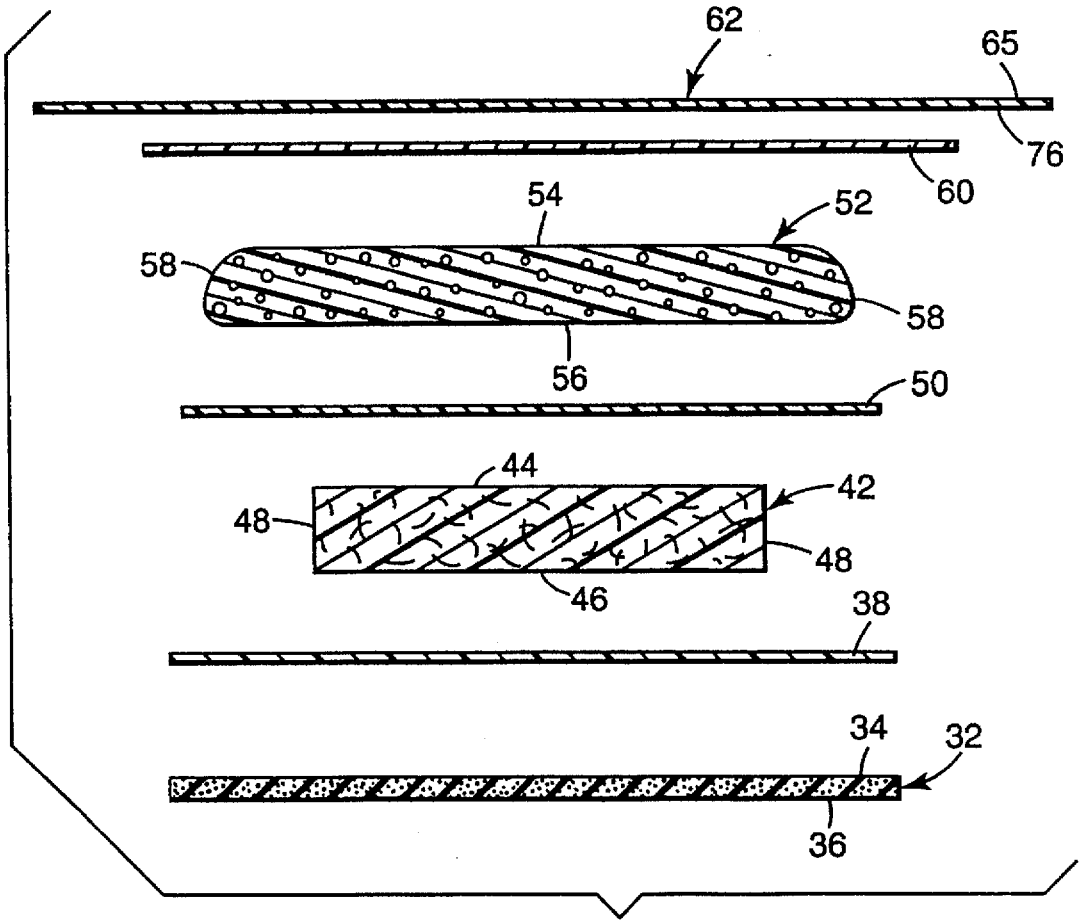
FIG. 4 is a sectional view of a two-layer embodiment of the armor panel.
Figure 5A:
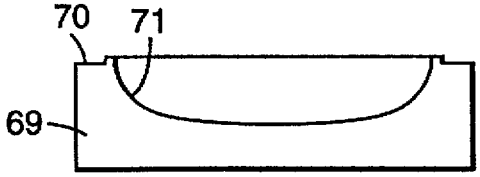
FIG. 5 is a diagrammatic view of a mould used in the methods for manufacturing the panel.
Figure 5B:
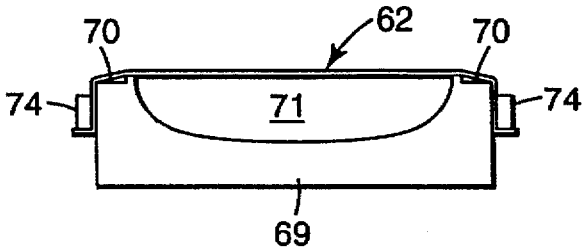
Figure 5C:
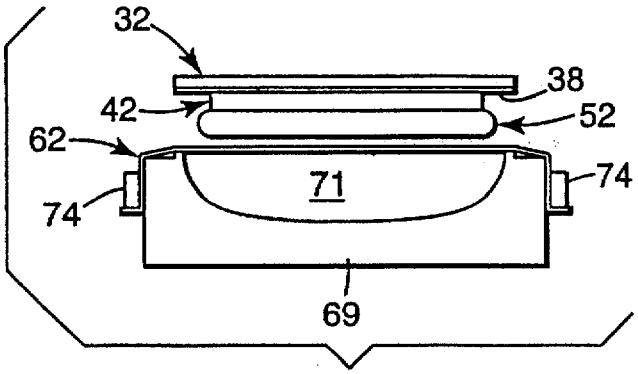
Figure 5D:
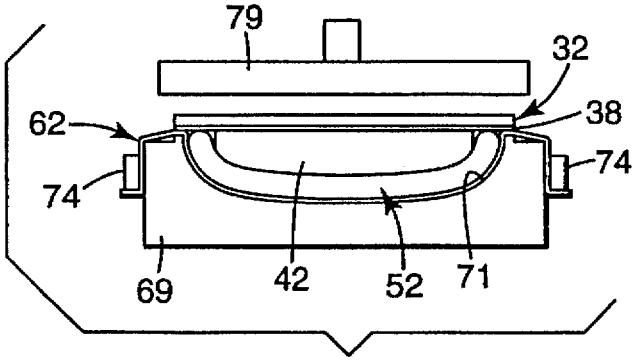
Figure 5E:
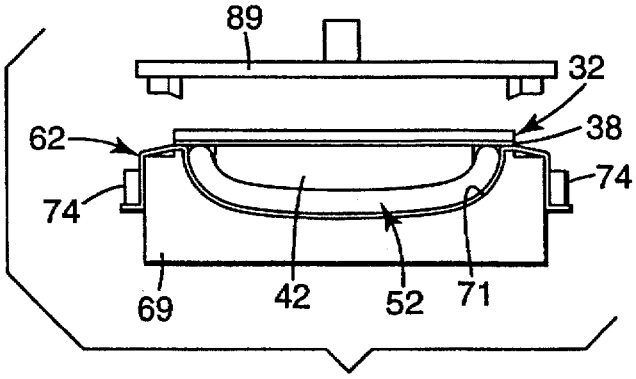
Figure 5F:
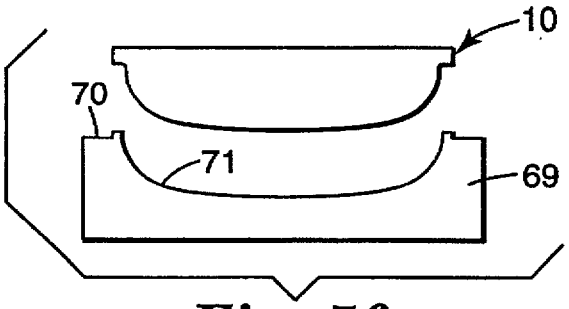
Figure 1:
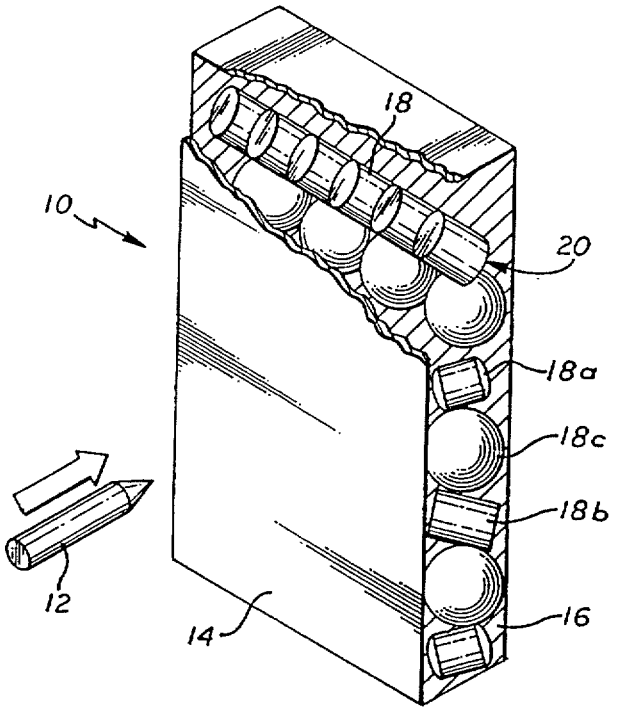
Figure 2:
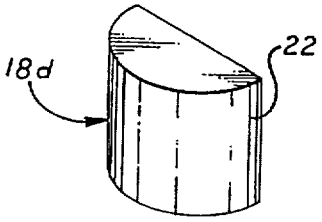
Figure 3:
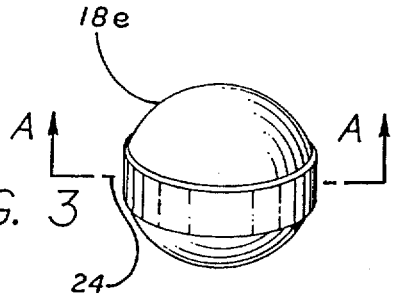

FIG. 4 illustrates a multi-layered, armor panel 26, having a configuration which is particularly suitable for armored clothing. In referring to the following further figures, similar identification numerals are used for identifying similar parts.

An outer, impacting panel 28 of composite armor material is similar to panel 14 described above with reference to FIG. 1. Panel 28 acts to deform and shatter an impacting high velocity projectile 12. Light-weight armor for personal protection is made using a tough, yet hard, thermoplastic resin, for example, polycarbonate or acrylonite-butadiene-styrene.

An inner panel layer 30 is adjacent to outer panel 28, and is advantageously attached thereto. Inner panel layer 30 has a thickness of at least 50% of that of outer impacting panel 28. Inner panel 30 is made of a tough woven material, such as multiple layers of Kevlar®, or a material known by its trade name of Famaston. In a further embodiment, inner layer panel 30 comprises multiple layers of a polyamide netting.

In operation, inner panel 30 causes asymmetric deformation of the remaining fragments 32 of the projectile 12, and absorbs remaining kinetic energy from these fragments by deflecting and compressing them in the area 34 seen in FIG. 1. It is to be noted that area 34 is much larger than the projectile cross-section, thus reducing the pressure felt on the inner side 36 of inner panel 30. This factor is important in personally-worn armor.

Referring now to FIG. 5, there is seen a casting mould 38, used for producing a composite armor material 10 as described above with reference to FIG. 1. The following elevated-temperature method of manufacture is used:

Step A

A mould 38 is provided, leaving a bottom 40, two major surfaces 42, two minor surfaces 44 and an open top 46, wherein the distance between these two major surfaces 42 is 1.2 to 1.8 times the major axis of the pellets 18. For example, 8 mm pellets are used and the distance between minor surfaces is 10

Step B

Pellets 18 are inserted into mould 38 to form a plurality of superposed rows 20 of pellets 18, extending substantially along the entire distance between the minor side surfaces 44, and from the bottom 40 substantially to the open top 46.

Step C

Mould 38 and the pellets 18 contained therein are incrementally heated, first to a temperature of about 100° C., and then further heated to a temperature of at least 100° C. above the flow point of the material to be poured in the mould. For example, aluminium has a flow point of about 540° C., and will require heating tile mould, together with ceramic pellets contained therein, to above 640° C. Depending on the alloy being used, it has been found advantageous to heat the mould to a temperature of 850° C.

Step D

Molten material 16 is poured into mould 38 to fill the same. A typical pour temperature range for aluminum is 830°–900° C. Polycarbonate is poured at between 250°–350° C. Advantageously, the surfaces of mould 38 are provided with a plurality of air holes 48, to facilitate the escape of air while molten material 16 is poured therein. During pouring, the pellets 18 are slightly rearranged in accordance with the hydrostatic and hydrodynamic forces exerted upon them by the molten material.

Step E

Molten material 16 is allowed to solidify.

Step F

Composite armor material 10 is removed from mould 38.

The following embodiment of a method of manufacture includes the use of an epoxy resin to form a thermoset matrix. As is known, epoxies can be cast at room temperature and chemically hardened, or their hardening can be accelerated by the application of heat. Epoxy armor is suitable for use on aircraft. Yield strength and Young's modulus are both improved by adding fiber reinforcement.

Step A

Mould 38 is provided, having a bottom 40, two major surfaces 42, two minor surfaces 44 and an open top) 46 wherein the distance between the two major surfaces 42 is from about 1.2 to 1.8 times the major axis of the pellets 18.

Step B

Pellets 18 are inserted into mould 38 to form a plurality of superposed rows 20 of pellets 18 extending substantially along the entire distance between the minor aide surfaces 44, and from the bottom 40 substantially to the open top 46.

Step C

Liquid epoxy, resin is poured into mould 38 to fill the same.

Step D

The epoxy is allowed to solidify.

Step E

The composite armor material is removed from mould 38.

Table 1 is a reproduction of a test report relating to the aluminium matrix multi-layer panel described above with reference to FIG. 4 Three armor-piercing bullets were fired at close range from an AK-47 assault rifle at a multi-layered panel having a total weight of 34.3 kg/m$^2$, a weight low enough for limited use as personally worn armor. The results reported prove the effectiveness of the panel manufactured according to the present invention.

TABLE 1

RESULTS TABLE

| SHOT NO. | GUN MODEL | BARR. LENG. inch | CALIBER mm. | BULLET TYPE | BULLET WEIGHT grain | SHOT ANGLE deg. | TRAUMA DEPTH inch | TRAUMA WIDTH inch | VEL. mtr/sec. | VEL. ft./sec. | PENETRAT Y/N | NO. LAYERS PENETRATED |
|---|---|---|---|---|---|---|---|---|---|---|---|---|
| 1 | AK-47 | 24.00 | 7.620 | A.P.I. | 125.0 | 0 | 0 | 0 | 739 | 2425 | N | 0 |
| 2 | AK-47 | 24.00 | 7.620 | A.P.I. | 125.0 | 0 | 0 | 0 | 757 | 2484 | N | 0 |
| 3 | AK-47 | 24.00 | 7.620 | A.P.I. | 125.0 | 0 | 0 | 0 | 741 | 2431 | N | 0 |
| AVERAGE OF NOT PENETRAT SHOTS | | | | | | | 0.0 | 0.0 | 745 | 2446 | | 0. |

SIZE: 300 × 250
TEMP.: 23.0 (deg. C.)
RANGE: 7.0 mtr.
SPEC.: NIJ. STD. 0108.01
PANEL WEIGHT sq. mtr: 22.300 kg.
HUMIDITY: 58%
LEVEL: 4
PANEL CONDITIONED: WET, IN WATER FOR: 0 hours
REMARKS: +12 KG/SQ. M. FAMASTON.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor material for absorbing and dissipating kinetic energy from high velocity, armor-piercing projectiles, comprising:

a panel consisting essentially of a single internal layer of high density ceramic pellets, said pellets having an $Al_2O_3$ content of at least 93%, and a specific gravity of at least 2.5 and retained in panel form by a solidified material which is elastic at a temperature below 250° C.;

the majority of said pellets each having a part of a major axis of a length of in the range of about 3–12 mm and being bound by said solidified material in a plurality of superposed rows;

wherein a majority of each of said pellets is in contact with at least 4 adjacent pellets, the weight of said panel does not exceed 45 kg/M$^2$.

2. A composite armor material as claimed in claim 1, wherein the majority of said pellets each has a part of a major axis of a length in the range of about 6–10 mm.

3. A composite armor material as claimed in claim 1, wherein said pellets are of a geometric form having at least one convex curved surface segment.

4. A composite armor material as claimed in claim 1, wherein said pellets have at least one circular cross- section.

5. A composite armor material as claimed in claim 1, wherein said pellets are of a configuration selected from the group consisting of round, flat-cylindrical and spherical shape.

6. A composite armor material as claimed in claim 1, wherein said pellets have a specific gravity of at least 3.

7. A composite armor material as claimed in claim 1, wherein said pellets have an $Al_2O_3$, content of at least 93%, and have a hardness of 9 on the Mohs scale.

8. A composite armor material as claimed in claim 1, wherein said solidified material contains at least 80% aluminium.

9. A composite armor material as claimed in claim 1, wherein said solidified material is a thermoplastic resin.

10. A composite armor material as claimed in claim 1, wherein said solidified material is an epoxy.

11. A multi-layered armor panel comprising:

an outer, impact-receiving layer consisting of a composite armor material for absorbing and dissipating kinetic energy from high velocity, armor-piercing projectiles, said material comprising a panel consisting essentially of a single internal layer of high density ceramic pellets, said pellets having an $Al_2O_3$ content of at least 93% and a specific gravity of at least 2.5 and retained in panel form by a solidified material which is elastic and which renders the panel elastic at a temperature below 250° C., the majority of said pellets each having a part of a major axis of a length in the range of about 3–12 mm and being bound by said solidified material in a plurality of superposed rows, wherein a majority of each of said pellets is in contact with at least 4 adjacent pellets and the weight of said panel does not exceed 45 $kg/m^2$, for deforming and shattering an impacting high-velocity, armor-piercing projectile; and an inner layer adjacent to said outer layer, comprising a tough woven textile material for causing an asymmetric deformation of the remaining fragments of said projectile and for absorbing the remaining kinetic energy from said fragments;

said inner layer having a thickness of at least 50% of that of said outer, impact-receiving layer;

wherein said panel is adapted to stop three bullets fired sequentially at a triangular area of said panel, the sides of said triangle being 5 cm each.

12. A multi-layered, armor panel according to claim 11, wherein said inner layer is made of Kevlar®.

13. A multi-layered, armor panel according to claim 11 , wherein said inner layer comprises multiple layers of a polyamide netting.

* * * * *

UNITED STATES PATENT AND TRADEMARK OFFICE

CERTIFICATE OF CORRECTION

PATENT NO. : 5,763,813

DATED : June 9, 1998

INVENTOR(S) : Michael Cohen and Avinoam Israeli

It is certified that error appears in the above-indentified patent and that said Letters Patent is hereby corrected as shown below:

The title page, should be deleted to appear as per attached title page.

The sheets of drawings consisiting of figures 1-5, should be deleted to appear as per attached figures 1-5.

Column 5, line 67, delete "round" and insert --cylindrical--.

Column 5, line 67, after "pellets"(first occurrence) insert --with at least one convexly-curved end face--.

Column 5, line 67, after "18a," delete "flat-".

Column 5, line 67, after "pellets"(second occurrence) insert --with at least one flat end face--.

Column 6, line 9, after "20" insert --as viewed in FIG. 1, it being understood that if the panel 14 is disposed horizontally the rows would be adjacent as viewed in FIG. 4--.

Signed and Sealed this

Second Day of November, 1999

*Attest:*

Q. TODD DICKINSON

*Attesting Officer*

*Acting Commissioner of Patents and Trademarks*

United States Patent [19]

Cohen et al.

[11] Patent Number: 5,763,813

[45] Date of Patent: Jun. 9, 1998

[54] COMPOSITE ARMOR PANEL

[75] Inventors: Michael Cohen; Avinoam Israeli, both of Mobile Post North Yehuda, Israel

[73] Assignee: Kibbutz Kfar Etzion, Israel

[21] Appl. No.: 704,432

[22] Filed: Aug. 26, 1996

[51] Int. Cl.[6] ..... F41H 5/04

[52] U.S. Cl. ..... 89/36.02; 109/84

[58] Field of Search ..... 89/36.02, 36.01; 109/82, 83, 84; 428/911

[56] References Cited

U.S. PATENT DOCUMENTS

| | | | |
|---|---|---|---|
| 3,523,057 | 8/1970 | Buck | 89/36.02 |
| 3,705,558 | 12/1972 | McDougal et al. | 109/84 |
| 4,061,815 | 12/1977 | Poole, Jr. | 428/215 |
| 5,134,725 | 8/1992 | Yeshurun et al. | 428/911 |
| 5,361,678 | 11/1994 | Roopchand et al. | 89/36.02 |

FOREIGN PATENT DOCUMENTS

| | | | |
|---|---|---|---|
| A1566448 | 5/1969 | France . | |
| A259254 | 8/1985 | France . | |
| A2711782 | 5/1995 | France . | |
| 2815582 | 3/1980 | Germany | 89/36.02 |
| A3228264 | 12/1985 | Germany . | |
| A3507216 | 9/1986 | Germany . | |
| A1081464 | 8/1967 | United Kingdom . | |
| A1352418 | 5/1974 | United Kingdom . | |
| A2272272 | 5/1994 | United Kingdom . | |

OTHER PUBLICATIONS

International Search Report (2pgs) conducted by the European Patent Office; File No. RS 96807; dated 27 Jun. 1996.

*Primary Examiner*—Stephen M. Johnson

[57] ABSTRACT

The invention provides a composite armor material for absorbing and dissipating kinetic energy from high velocity, armor-piercing projectiles, comprising a panel consisting essentially of a single internal layer of high density ceramic pellets having an $Al_2O_3$ content of at least 85% and a specific gravity of at least 2.5, said pellets being directly bound and retained in panel form by a solidified material which is elastic at a temperature below 250° C., the majority of said pellets each having a major axis in the range of about 3–12 mm, and being bound by said solidified material in a plurality of superimposed rows, wherein a majority of each of said pellets is in contact with at least 4 adjacent pellets, and the total weight of said panel does not exceed 45 kg/m$^2$.

13 Claims, 2 Drawing Sheets

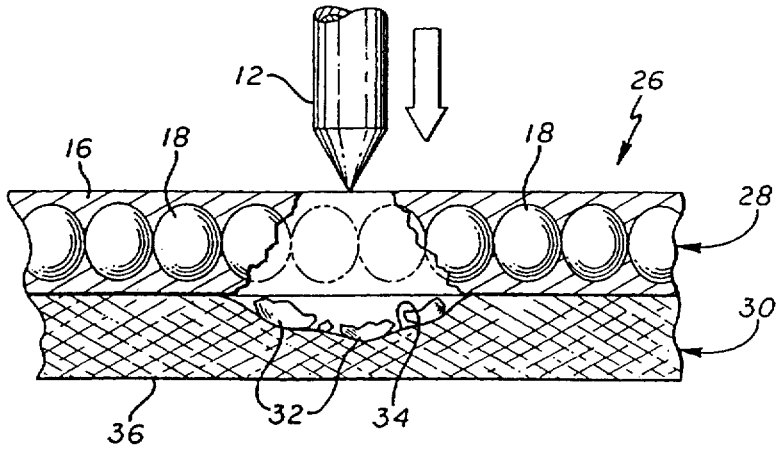

FIG. 4
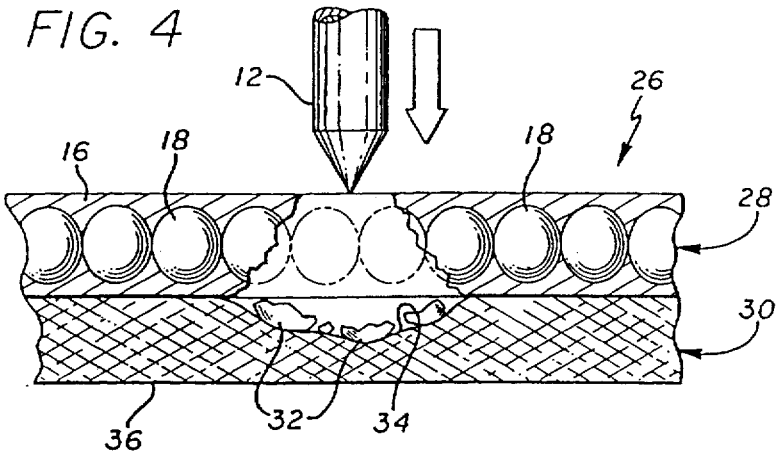
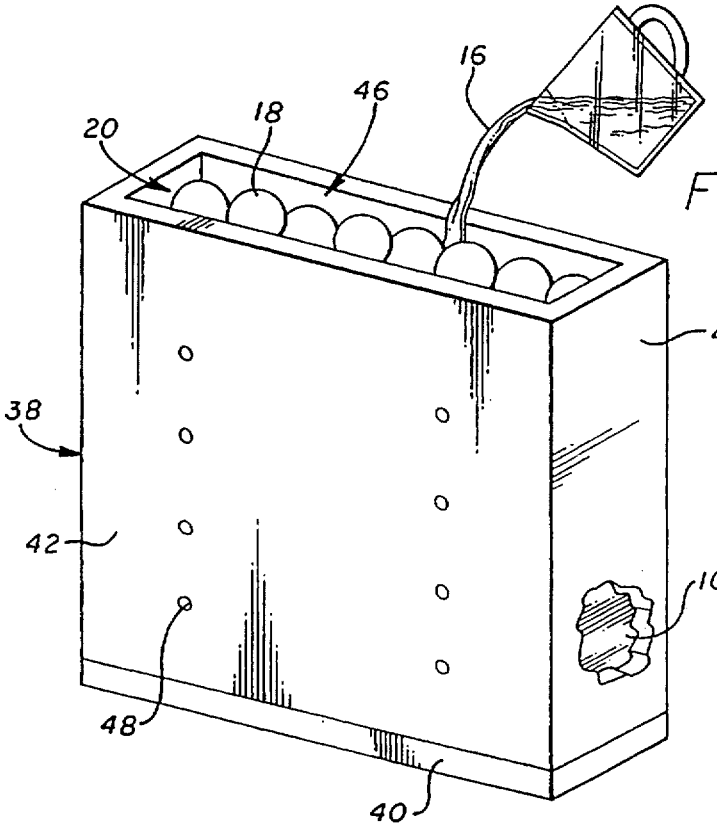
FIG. 5